US006299345B1

(12) United States Patent
Burnette

(10) Patent No.: US 6,299,345 B1
(45) Date of Patent: Oct. 9, 2001

(54) REMOTE PAGER FOR CHESS COMPETITION

(76) Inventor: Rodney Allen Burnette, 207 Morningview Heights, Hillsville, VA (US) 24343

( * ) Notice: Subject to any disclaimer, the term of this patent is extended or adjusted under 35 U.S.C. 154(b) by 0 days.

(21) Appl. No.: 09/442,902

(22) Filed: Nov. 18, 1999

(51) Int. Cl.[7] ..... G04F 3/00; G04C 21/00; A63F 3/00

(52) U.S. Cl. ..... 368/96; 368/250; 273/237; 273/260

(58) Field of Search ..... 368/89, 96, 245, 368/250; 373/237–239, 260; 340/825.44

(56) References Cited

U.S. PATENT DOCUMENTS 3,654,392 * 4/1972 Beinhocker et al. .
3,937,004 2/1976 Natori et al. .
5,129,654 * 7/1992 Bogner ..... 273/238
5,619,181 4/1997 Murray .
5,666,331 * 9/1997 Kollin ..... 368/245

OTHER PUBLICATIONS

Digital and Analog Chess Clocks, pp. 1–3, http:/?www.chessmate.com/chessclocks.html.

* cited by examiner

*Primary Examiner*—Vit Miska
(74) *Attorney, Agent, or Firm*—Kilpatrick Stockton LLP

(57) ABSTRACT

Providing a chess player with a pager so that the chess player can leave the chess board and still be notified when it is time for the chess player to make his move. A conventional chess timer has a switch to indicate when an opponent has made a move. The present invention activates a radio frequency transmitter by the switch to send a signal to a pager tuned to receive the signal sent by the transmitter. When the pager receives the radio frequency signal, the receiver generates a vibration and/or turns on a light, and/or less preferably generates a sound whereby a player can be notified at a remote location that an opponent has made his move.

14 Claims, 4 Drawing Sheets

REMOTE PAGER FOR CHESS COMPETITION

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

In the game of Chess and in some other games, such as Go and Shogi, the time that it takes a player to make his moves can become a deciding factor in the outcome of the game. It therefore very important that a player resume play as soon as possible after an opponent makes a move. Also sitting at a table for the length of a long chess game can be uncomfortable and needs often arise which require a player to leave a table for a short period, such as going to the bathroom, an important phone call, medication, smoking a cigarette, or even a drink or a snack. It is of course important that the time away from the chess table be as short as possible after the opponent makes his move.

Remote pagers are known. For example see U.S. Pat. 3,937,004 of Natori et al (1976). Natori discloses, "An electronic timepiece, used as a pager watch, has a speaker . . . for reproducing an external call signal intercepted by a receiver for incoming magnetic waves . . . . Sensors responsive to abnormal ambient conditions, e.g. temperature or blood pressure of the wearer, may also operate the speaker. (See the abstract) "Unit 25A comprises a plurality of sensors 25, 26, 27 designed to detect certain abnormal ambient conditions such as gas or radiation;" (See Col. 2, lines 38–40) A "game timing" unit is described at Col. 1, line 50 and line 67 to Col. 2, line 6. "Unit 8A further includes a 100 Hz signal generator 6 and a reset circuit, the latter being controlled by external switches not shown. Circuits 6 and 7 work into changeover circuit 8 for modifying the time display of unit 1A, in a manner not relevant to our present invention, . . . ". It follows the term "game timing unit" is a mistranslation.

Beepers in combination with chess clocks are also known, but these are not remote beepers. They are beepers built into the clock to notify each player when the player's time for playing has expired. These timer-beeper combinations are advertised at http:/www.chessmate.com/chessclocks.html. They are known as the A-19 The "Chronos" Digital Timer, and the A-10 "The Duel Timer". The sound of the beepers in a chess tournament is distracting though helpful. The timers can be digital or analog. Normally two timers are contained in a single case, however the timers could be separate timers.

For a discussion of remote pagers that alert a user by vibration and or light and or sound, see U.S. Pat. No. 5,619,181 Murray (1997) assigned to Motorola.

BRIEF SUMMARY OF THE INVENTION

The present invention is directed to an improvement in game timers, and more specifically chess clocks. The terms "Chess Timers" and Chess Clocks" are used herein to include other game timers such as timers for Go and Shogi, which measure the time it takes for a player to make a move. Each electric Chess timer has a switch to stop the timer when a player has made a move. The present invention is directed to a radio frequency transmitter activated by the switch to send a signal to a remote receiver tuned to receive the signal sent by the transmitter. The receiver in turn preferably generates a vibration and/or turns on a warning light and/or generates a sound. A sound is not preferred as quiet is essential in chess tournaments. By the use of the apparatus of the present invention a player can be quietly notified at a remote location that an opponent has made his move. The player can then return as soon as possible to the chess board to resume playing. This is important because in tournament chess a player has only a limited amount of time to complete a game. The player can also wait in order to cause the opponent to wonder what the waiting player is up to.

The remote receiver can be based upon a conventional pager, a wrist watch pager, a small telephone pager, or a remote door alarm chimes among other things. The vibrating alarm, light or audio alarm generated by the remote receiver can be any indicating devices commonly used in conventional pagers, such as Motorola's AmeriPage pager or the Motorola Minitor III pager. Pager technology is known in the art and will not be described in detail in this application. The present pager systems of the present invention however preferably operate at frequencies and outputs allowed by the FCC without a license.

Briefly, the chess timer of the present invention has a switch to stop the timer when an opponent has made a move, a radio frequency transmitter activated by the switch, and a receiver tuned to receive the signal sent by the transmitter to generate a vibration and/or light and/or sound whereby a player can be notified at a remote location that an opponent has made his move.

As an option, the receiver can contain a timer reading the same time as the players' game timer. By players' game timer is meant the timer that records the time the player has consumed making moves. By chess clock or chess timer, is meant in the present application, a single chess clock or chess timer. In normal usage, a chess clock often refers to two clocks in a single case and a chess timer often refers to two timers in a single case, one for each player.

Many chess players will utilize the present invention, the users will be opponents. Two players at the same board can have two transmitters incorporated into two corresponding chess timers. The two chess timers are usually in a single case. Preferably each of the transmitters are tuned to generate a different frequency, and each of the receivers are tuned to receive a single from a different corresponding transmitter. The transmitters can be on separate circuit boards, or on the same board. The transmitters can be contained in the dual timer cabinet or attached to the cabinet. The two transmitters can transmit at the same frequency, though this is not preferred, but the system only requires one transmitter for both remote receivers.

In a timed chess match using a timer having a switch to stop the timer when an opponent has made a move, the present invention is directed to activating a radio frequency transmitter by the switch to transmit a radio frequency signal to a remote receiver tuned to receive the signal, receiving the radio frequency signal by the receiver, and generating a physical indication in response to the received radio frequency signal whereby a player is notified at a remote location that the opponent has made his move.

Preferably the physical indication is a vibration. The physical indication can also be a light, alone or in combination with the vibration. The physical indication can also be a sound, alone or in combination with the light and/or vibration.

The chess timer has a conventional switch to stop the timer when an opponent has made a move. The present invention adds a radio frequency transmitter activated by the switch in combination with a receiver tuned to receive the signal sent by the transmitter to generate a vibration and/or light and/or sound whereby a player can be notified at a remote location that the opponent has made his move.

An added feature of the present invention is a timer reading the same time as the game timer incorporated into the receiver.

Normally two game timers are contained in a single case. The present invention adds two transmitters to either the inside or the outside of the case and includes two receivers, each tuned to a corresponding respective transmitter and each receiver capable of receiving a signal remote from the corresponding transmitter. The two radio frequency transmitters preferably transmit different frequencies, and each of the two receivers is tuned to a corresponding different transmitters. One transmitter can be used for both players, but this creates confusion. Also both transmitters can be incorporated into a single circuit or chip, with a switching device to switch to different oscillating frequencies. For example two oscillating crystals, oscillating at different frequencies can be switched to and from. It is necessary that all transmitters in a game room transmit at different frequencies, to prevent the wrong player from being paged at the wrong time.

DETAILED DESCRIPTION OF THE INVENTION

Figure 1:
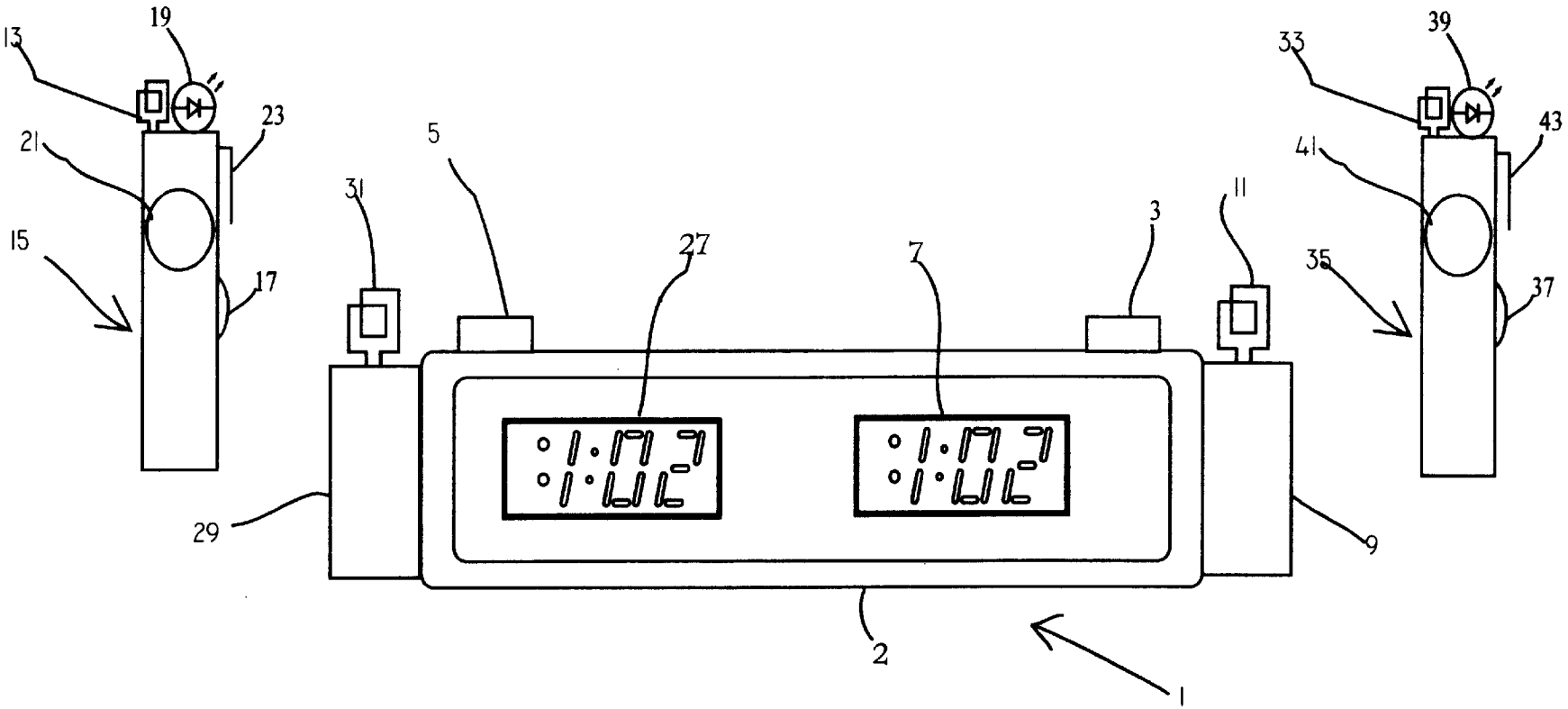
FIG. 1 shows the combination of chess timer-transmitter and remote pager.

Turning now to FIG. 1, there is shown a dual digital timers 1 in a single case 2. A push button electrical switch 3 is provided for player number one and a second push button electrical switch 5 is provided for player number two. There is a conventional rocker arm 6 (see FIG. 2) associated with dual digital chess clocks that provides when one clock switch is opened all the way, the other clock switch is closed. When player number one presses push button switch 3, the timer 7 (clock) associated with player number one stops and the timer 27 associated with player number two starts. When the switch 3 to timer 7 is opened A transmitter 9 associated with the case 1 is turned on sending a radio frequency signal by antenna 11 to antenna 13 of pager 15. In pager 15 the signal turns on a vibrator 17 which alerts player number two that player number one has made a move and that it is time to resume play. Optionally or alternatively LED 19 (a light) is also turned on to alert player number two. Least preferably, a sound is optionally or alternatively generated by sound generator 21. Clip 23 is a conventional pager clip used to attach pager 15 to a belt or garment. Clip 23 can be removed to carry pager 15 in a pocket.

The operation of the remote paging system will now be described in relation to the play of player number two, who has now returned to the board in response to being paged by player number one pushing button switch 3. Player number one leaves the room, and player number two resumes play. After player number two makes a move, player number two presses push button switch 5. When player number two presses push button switch 5, the timer 27 associated with player number two stops. A transmitter 29 associated with the case 1 is turned on sending a radio frequency signal by antenna 31 to antenna 33 of pager 35. In pager 35 the signal turns on a vibrator 37 which alerts player number one that player number two has made a move and that it is time for player number two to resume play.

Figure 2:
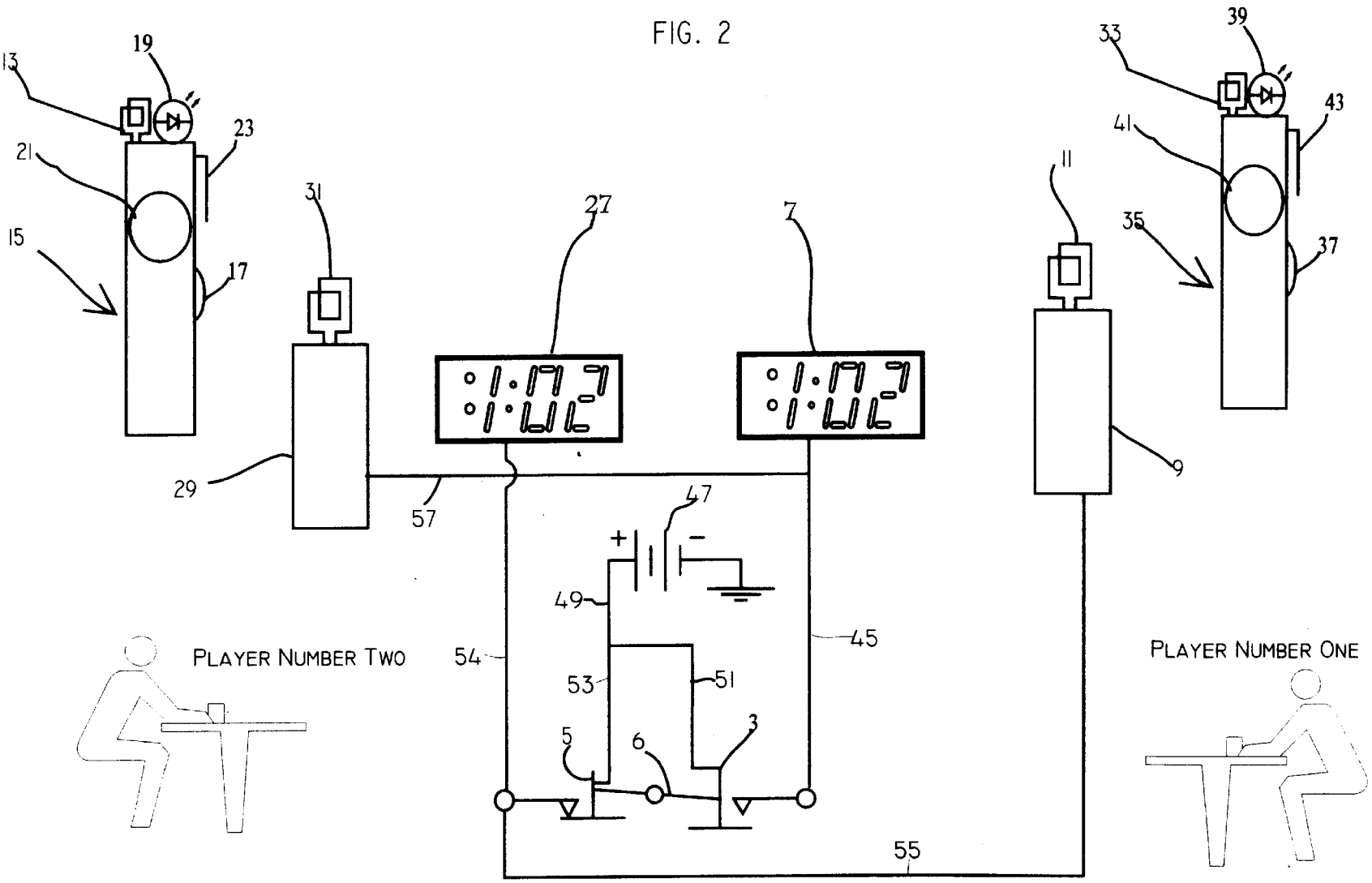
FIG. 2 is a schematic diagram of the modifications of the present invention as applied to player number one leaving the table.
Figure 3:
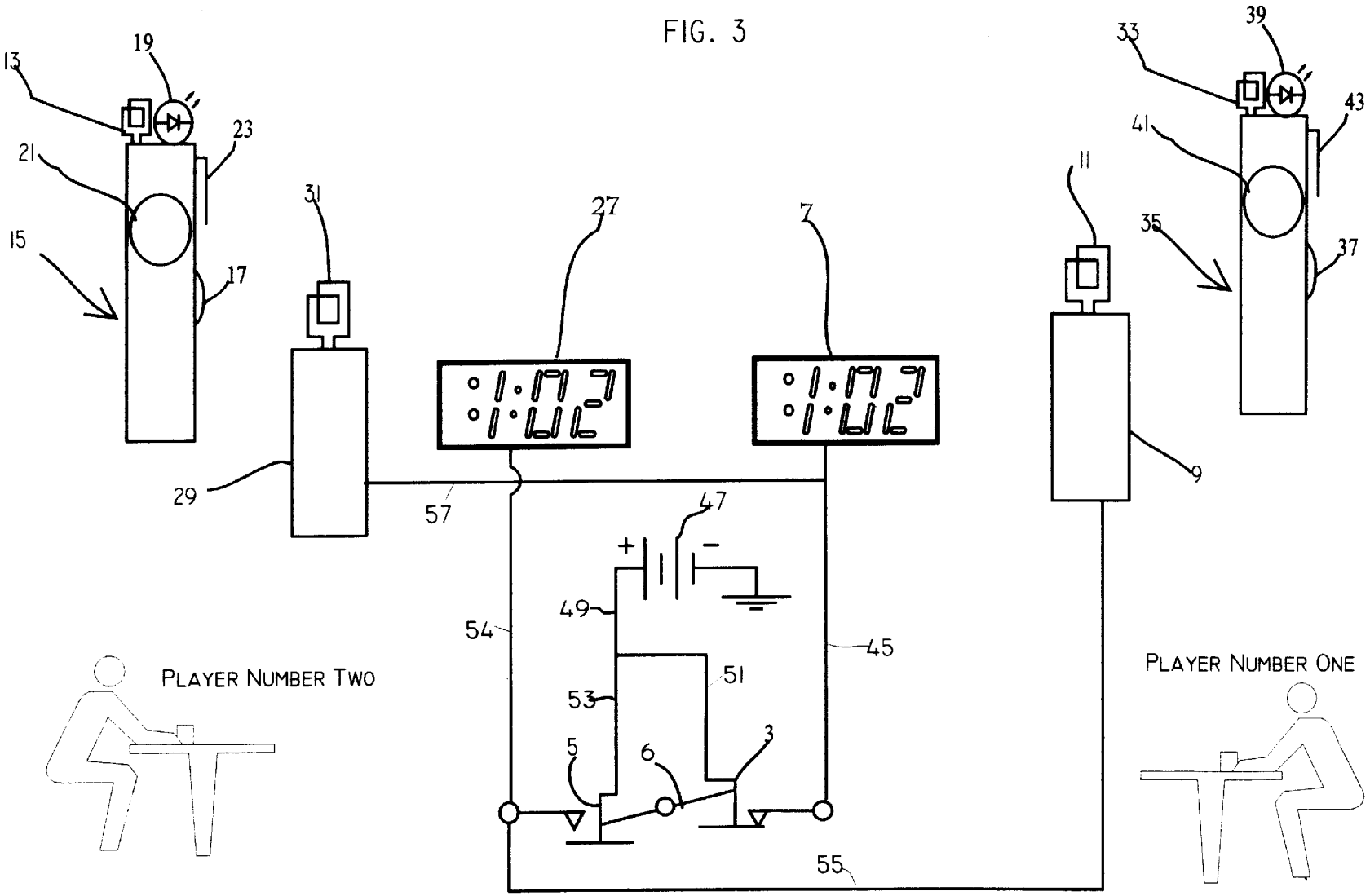
FIG. 3 is a schematic diagram of the modifications of the present invention as applied to player number two leaving the table.
Figure 4:
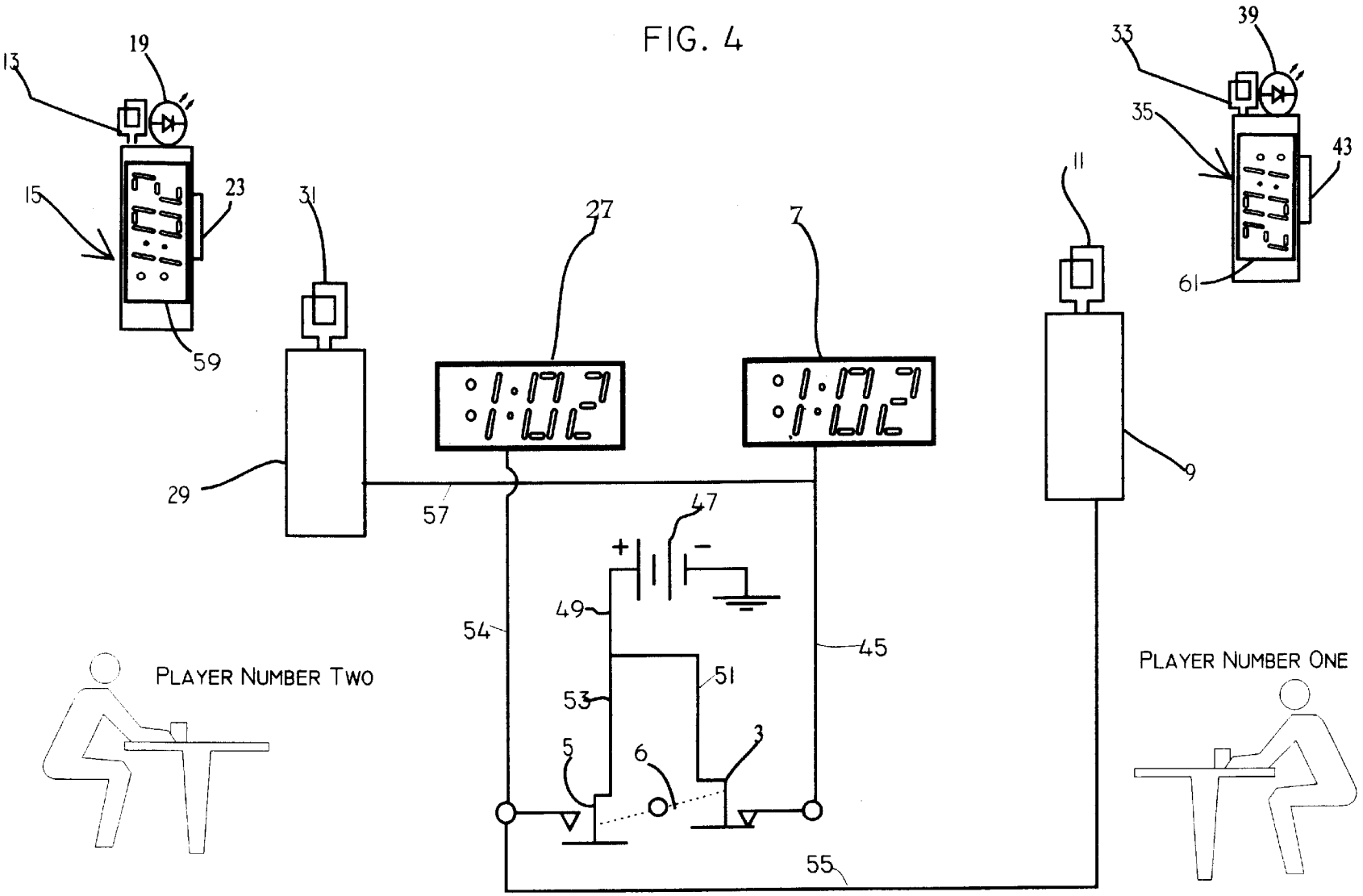
FIG. 4 is a top view of the pagers employed in the present invention showing the pager timers.

The circuit modifications made in the construction of one embodiment of the present invention are shown in FIG. 2 and FIG. 3. A push button electrical switch 3 is provided for player number one and a second push button electrical switch 5 is provided for player number two. There is a conventional rocker arm 6 associated with dual digital chess clock 1. When player number one makes a move and presses switch 3, the current from conductor 45 is to timer 7 is cut off and timer 7 stops. The current comes from battery 47 and flows through conductors 49 and 51 to switch 3. By the opening of switch 3, rocker arm 6 closes switch 5 causing a current to flow from battery 47 through conductors 49 and 53 to switch 5. When switch 5 is closed a current also flows through conductor 54 to timer 27 starting timer 27 of player number two and current flows through conductor 57 to transmitter 9 turning on transmitter 9. Transmitter 9 sends a signal to receiver 15 which alerts player number two that player number two's timer is running. The signal also switches on remote timer 59 in receiver which displays the time left on player number two's clock. The closing of switch 3 and the resulting opening of switch 5 stops the transmission of transmitter 9 and the reception by receiver 15 and stops remote timer 59 (See FIG. 4).

Player number two now returns to play. After player number two makes a move and presses switch 5 (see FIG. 3), rocker arm 6 opens switch 5 cutting off current through conductor 54 to timer 27 and stopping timer 27. Switch 3 of player one closes sending current through conductor 45 and timer 7 starts. The current comes from battery 47 and flows through conductors 49 and 51 to switch 3. Current is also sent through conductors 45 and 57 to transmitter 29. Transmitter 29 sends a signal to receiver 35 which alerts player number one that player number one's timer 7 is running. The signal also switches on remote timer 61 in receiver 35 which displays the time left on player number one's clock. The closing of switch 5 and the resulting opening of switch 3 stops the transmission of transmitter 29 and the reception by receiver 35 turning off remote timer 61 (See FIG. 4).

In the actual construction of the remote pager, one Radio Shack remote door chimes transmitter was electrically connected to one timer switch and a second Radio Shack remote door chimes transmitter was attached to the second timer switch. The two transmitters operated at different frequencies so that only one transmitter would activate only one receiver. In the preferred embodiment a vibrator and/or light is activated by the receiver to notify a player that the opponent has made a move. The specific electronics is either known in the art or is enabled by the present disclosure. The present invention is directed to the application of electronics and is the best mode known to the inventor.

What is claimed is:

1. A game timer comprising:

timer capable of starting and stopping;

a switch for starting or stopping the timer;

a radio frequency transmitter capable of generating a signal in response to being activated by the switch;

a receiver tuned to receive the signal sent by the transmitter and capable of generating at least one of: a vibration, light and/or sound in response to receipt of the signal.

2. The game timer of claim 1 further comprising a second timer for recording total game time incorporated into the receiver.

3. The game timer of claim 1 further comprising:

a second timer capable of starting and stopping;

a second switch for starting or stopping the second timer;

a second radio frequency transmitter capable of generating a second signal in response to being activated by the second switch;

a second receiver tuned to receive the second signal sent by the transmitter and capable of generating at least one of: a vibration, light and/or sound in response to receipt of the second signal.

4. The game timer of claim 3 wherein the first and second signals are different frequencies.

5. The game timer of claim 1 wherein a light is generated in response to the signal.

6. The game timer of claim 1 wherein a vibration is generated in response to the signal.

7. The game timer of claim 1 wherein a sound is generated in response to the signal.

8. The game timer of claim 3 wherein a light is generated in response to the signal and a light is generated in response to the second signal.

9. The game timer of claim 3 wherein a vibration is generated in response to the signal and a vibration is generated in response to the second signal.

10. The game timer of claim 3 wherein a sound is generated in response to the signal and a sound is generated in response to the second signal.

11. A method in a chess match using a timer having a switch to stop a timer when an opponent has made a move, the improvement comprising the steps of activating a radio frequency transmitter by the switch to transmit a radio frequency signal to a remote receiver tuned to receive the signal, receiving the radio frequency signal by the receiver, and generating a physical indication in response to the received radio frequency signal whereby a player is notified at a remote location that an opponent has made his move.

12. The method of claim 11 wherein the physical indication is a vibration.

13. The method of claim 11 wherein the physical indication is a light.

14. The method of claim 11 wherein the physical indication is a sound.

* * * * *